United States Patent [19]

Moser

[11] Patent Number: 4,518,156

[45] Date of Patent: May 21, 1985

[54] METHOD FOR CONVEYING FOLDED SHEETS

[75] Inventor: James R. Moser, Easton, Pa.

[73] Assignee: Stobb, Inc., Clinton, N.J.

[21] Appl. No.: 619,545

[22] Filed: Jun. 11, 1984

Related U.S. Application Data

[62] Division of Ser. No. 421,157, Sep. 22, 1982, Pat. No. 4,482,141.

[51] Int. Cl.[3] ..... B65H 39/02

[52] U.S. Cl. ..... 270/54; 198/644; 198/479; 198/485; 271/185

[58] Field of Search ..... 270/54–56, 270/53, 58; 198/644, 617, 485–486, 479; 271/261, 262, 184, 185

[56] References Cited

U.S. PATENT DOCUMENTS

| | | | |
|---|---|---|---|
| 4,121,818 | 10/1978 | Riley et al. | 270/54 |
| 4,170,346 | 10/1979 | Murray et al. | 270/54 |
| 4,236,706 | 12/1980 | Schlough | 270/54 |
| 4,260,145 | 4/1981 | Mebus et al. | 270/54 |
| 4,383,683 | 5/1983 | Rathert | 270/54 |

FOREIGN PATENT DOCUMENTS

| | | | |
|---|---|---|---|
| 2010784 | 7/1979 | United Kingdom | 270/54 |

*Primary Examiner*—E. H. Eickholt
*Attorney, Agent, or Firm*—Arthur J. Hansmann

[57] ABSTRACT

Apparatus for conveying folded sheets along a raceway and in an inverted V-shaped position and moving the sheets to an elevating conveyor which turns the sheets onto their sides where the sheets can then be further moved into a trimmer or stacked or the like. The apparatus provides for safe and accurate transport of the sheets and for movement at a constant velocity so that the sheets can be moved at the high speed of the printing press which is producing these sheets. Also, an orbital type of device is utilized for picking up the sheets from the raceway and like conveyor while maintaining the sheets in their horizontal orientation and then presenting the sheets to the vertical elevating conveyor, all without upsetting the relationship between the sheets in the multiplicity of folded sheets such as a signature. Further, the sheets are moved through a caliper section where the size of the sheets is detected, and any sheets which are not of standard size are then culled out of the stream of sheets by means of a reject gate which removes the non-standard size sheets from the stream. A method is employed to move the folded sheets at a continuous high-speed velocity. The sheets are elevated and then laid onto their side.

7 Claims, 7 Drawing Figures

6
94
96
129
92
93
66
89
127
100
97
98
98
7
7
126
123
115
124
116
122
128
117
121
118
17
16
68
102
119
61
6
S
19

METHOD FOR CONVEYING FOLDED SHEETS

This is a division of U.S. patent application Ser. No. 421,157, filed Sept. 22, 1982, now U.S. Pat. No. 4,482,141 entitled "Method and Apparatus for Conveying Folded Sheets".

This invention relates to apparatus for conveying folded sheets which are actually sheets of paper coming from a printing press folded in the form of a book or magazine and draped over a raceway, and a method therefor.

BACKGROUND OF THE INVENTION

The prior art is already aware of the concern and problem for handling and conveying sheets which come from a printing press, and these sheets are commonly folded and are colated and stitched or stapled and then trimmed and stacked. The industry is concerned about being able to move the sheets at a high speed which is sufficient to keep up with the speed of the printing press and to yet handle the sheets carefully and accurately so that they are properly aligned and can form a neat final product of a book or magazine or the like. Thus, sheets are commonly positioned in the so-called saddle position along a raceway on which the sheets are draped in an inverted V-position with the fold line at the top edge of the sheets. A chain system is commonly employed for pushing the folded sheets along the raceway and the sheets are stitched at the folded edge and they are then formed into stacks.

The present invention provides apparatus for conveying the folded sheets along the raceway and toward the trimmer or the like while moving the sheets at one continuous, and even constant velocity. Accordingly, a high-speed movement is achieved, and the sheets are accurately and neatly handled without damage or misalignment between the stitching process and the trimming process.

In accomplishing the aforementioned, apparatus is provided for receiving the sheets from the raceway and to lift the sheets into an elevating type of conveyor which lays the sheets flat on their sides and then moves the sheets into positions for stacking or the like. In accomplishing this objective, clamp pads are employed for straddling the folded sheets and pressing them together while lifting them from the transition of the raceway to the vertical elevating conveyor mentioned, and to do so without upsetting the relationship between the folded sheets and to do so at the high speed in continuous velocity mentioned.

A further object and accomplishment of this invention is to provided apparatus for the conveyance of folded sheets and to pass them through a caliper section of apparatus where the size of the sheets can be determined and to then continuously pass the sheets in a stream to where any sheets which have been detected to be a non-standard size are diverted from the stream and placed into a reject location. The reject sheets can then be reclaimed and placed back into the apparatus for proper sizing and colating and final movement to the final formation of the book or magazine.

The present invention also provides a method for conveying folded sheets of paper through a caliper section, a stitcher, and to a trimmer, all at one continuous, and even constant, velocity. A high velocity is achieved, and the sheets are handled without damage or misalignment.

Also, the method sorts out sheets which are not of a standard size, and those sheets are diverted from the path of the standard size sheets. This is accomplished while the sheets are continuously moving, and the method and apparatus therefore keep up with the high speed production of the printing press and the folder.

BRIEF DESCRIPTION OF THE DRAWINGS

FIG. 5 is a view similar to that shown in FIG. 4.

DETAILED DESCRIPTION OF THE INVENTION

Figures 1, 3:
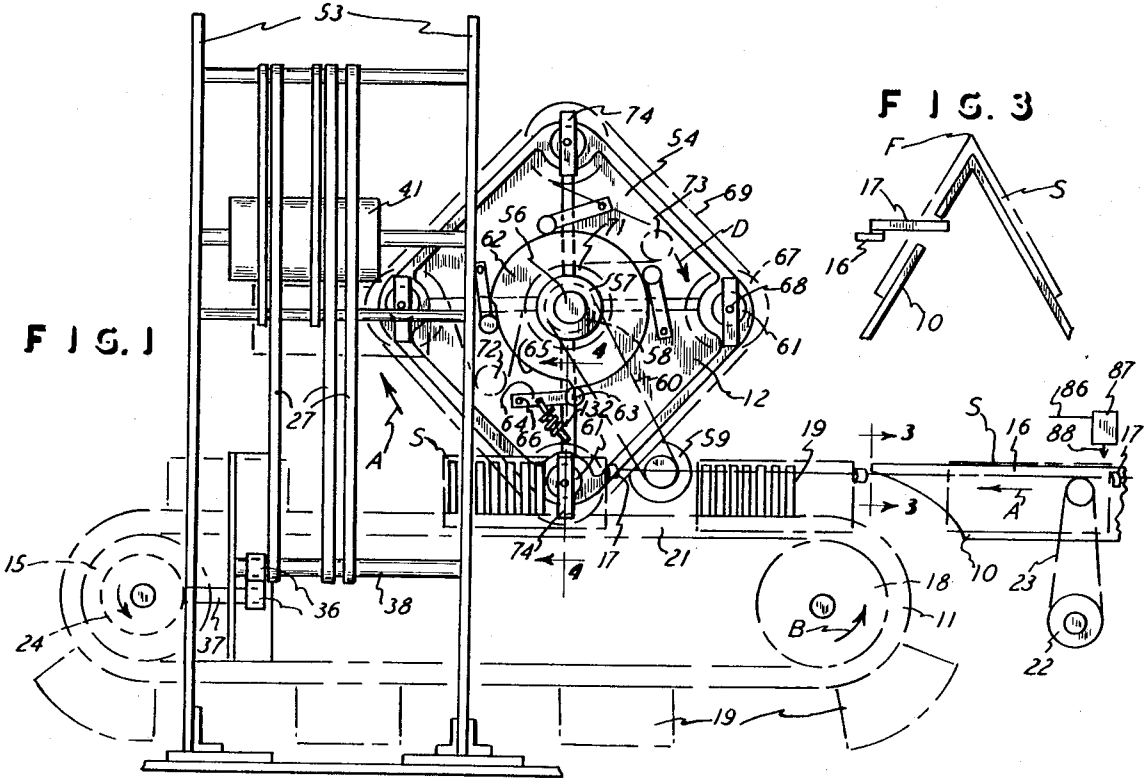
FIG. 1 is a front-elevational view of apparatus for carrying out this invention.
FIG. 3 is an enlarged view taken along the line 3—3 of FIG. 1.
Figure 2:
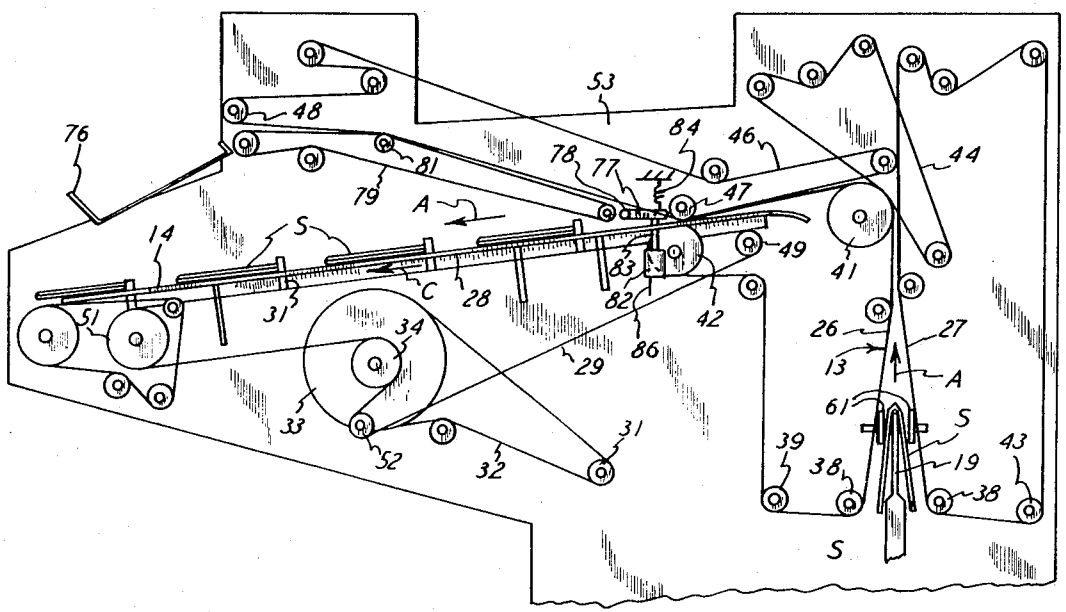
FIG. 2 is a left-side elevational view of that shown in FIG. 1.

This invention is best described in connection with the apparatus shown in the drawings where FIGS. 1 and 2 show the folded sheets S which are moved in a constant velocity in the direction of the arrows A. The sheets move along the conventional raceway 10 and to a blade chain 11 and then to an orbiting device 12 and then to a vertical conveyor 13 and then to a substantially horizontal conveyor 14. The movement is at a continuous and constant velocity so that the sheets S are moved continuously and at a high speed and therefore accomodate the normally high output speed of a printing press (unshown). Particularly, the orbital device 12 picks up the sheets S and moves them initially at the same horizontal speed as that of the blade chain 11 and also moves them at the same vertical speed as that of the vertical conveyor 13, so the sheets are continuously and gently handled in that movement.

The raceway 10 is shown in FIG. 3 to be of the standard inverted V-shape, and the sheets S are draped thereover with the sheets in a folded condition and having the fold F at the very top thereof and horizontally disposed and the sheets move in the direction of that horizontal fold-line, that is, to the left, as viewed in FIG. 1. The sheets S are engaged by a pusher chain 16 which carries pushers 17 engaging the trailing edges of the folded sheets S to move them along the raceway 10 and onto the blade chain 11 which is movably mounted on sprockets 15 and 18 which rotate in the direction of the arrow designated B. The raceway 10 and the blade chain 11 are adjacent each other and are suitably related and positioned so that upstanding blades 19 on the chain 21 of the blade chain conveyor 11 engage the inside of the folded sheets S and support the sheets S along the fold-line F, as seen in FIG. 2, for instance. It will be noted that the pusher chain 16 extends into the reach of the blade chain 11 and thus the pushers 17 move the sheets S onto the upstanding blades 19, and thus the sheets S were initially draped over the raceway 10 and are then draped over the blade chain 11 which is in the nature of an extension conveyor for the raceway 10. The pusher chain 16 is driven by a powered driver 22 which can be connected to the chain 16 through a drive chain or the like 23, and the blade chain 11 can be driven by a powered driver 24 which is in driving relation to the sprocket or the like 17, all in any conventional arrangement, and the drivers 22 and 24 are synchronized in their driving motion so that the pusher chain 16 moves at the same linear speed as that of the blades 19, all so that the sheets S are continuously moved at one velocity along and from the raceway 10 and onto and by the blade chain 11.

The orbital device 12 clamps onto the sheets S and lifts the folded sheets into the grip of the conveyor 13 which consists of the two lengths of conveyor belts 26 and 27. The drive for the conveyor 13 is also synchronized with the previously referred to drives 23 and 24 so that the sheets S continue to travel in the constant velocity while they now move vertically and are retained by the two belts 26 and 27 on opposite sides of the folded sheets S and after the orbital device 12 has passed the sheets to the conveyor 13 and has released the sheets.

The conveyor 13 passes the sheets to a substantially horizontally disposed table 28, and a pusher chain or the like 29 has spaced-apart pushers 31 extending therefrom and through the table 28 to engage the then trailing edges of the folded sheets S and move them along the table 28 in the direction of the arrow A and again that movement is at the constant velocity mentioned and the drive 31 is connected through a drive belt or the like 32 to a driven pulley or the like 33 which engages the chain 29 through the sprockets or the like 34, as shown in FIG. 2.

Thus, the conveyor 13 can have the driven members 36 connected through a shaft 37 from the driver 24, and the member 36 can be in driving relation to the shafts 38 for the belts 26 and 27 so that the belts 26 and 27 move at the same speed and the constant velocity mentioned while lifting the folded sheets. The belt 26 is shown to extend around several smaller pulleys 39 and a drum 41 and a larger pulley 42. The belt 27 is shown to extend around six small pulleys 43, and of course both belts 26 and 27 are endless. Also, a belt 44 extends over the drum 41 to guide the outer face of the folded sheets around the drum 41 and into the grip or control of a conveyor 46 which extends above the conveyor belt 26 and extends around the small pulley 47, as shown. The guide-belt 46 also extends around the small pulley 48 and the other small pulleys shown, but the belt 46 at the location of the pulley 47, along with the belt 26, directs the folded sheets onto the table 28 where the sheets are released from the belts and are picked up by the chain 29, as described. The chain 29 extends around a small pulley 49 and a larger pulley 51, in addition to the pulley 34 and the smaller pulley 52, and of course the chain moves in the direction of the arrow designated C.

The folded sheets S are therefore initially moved along the raceway 10 in the horizontal direction and are then moved vertically by the conveyor 13 and the folded sheets are then moved at a right-angle to the side when they turn around the drum 41 and are placed onto the table 28. The folded edge F is the leading edge in the vertical movement and also in the right-angled substantially horizontal movement on the table 28. Also, it will be noted that the conveyor 13 is supported by upstanding frame members 53 which support the shafts carrying the various pulleys and the drum and the like for conveyor 13. It should be further understood by anyone skilled in the art that the pushers 17 on the pusher chain 16 are arranged and disposed so that they engage the trailing edges of the folded sheets and move them into the control of the orbital device 12 at which point the pusher 17 will pivot out of the way to leave the folded sheets completely under the control of the orbital device to be described hereinafter.

FIG. 1 shows that the orbital device 12 generally consists of a square-shaped member 54 which is rotatably mounted on a fixed and non-rotatable shaft 56 which is of course suitably supported in any conventional arrangement. The member 54 has a hub 57 which carries a sprocket or the like 58 which is rotated by a motor or drive member 59 drivingly connected through a drive chain or belt 60, as shown. The member 54 rotates in the direction of the arrow-designated D, and each of the four corners of the member 54 carries a pair of facing clamp pads 61 which actually engage opposite faces of the folded sheet passed between the pads 61, such as shown in the FIG. 2 position. The clamping and opening action for the pads 61 relative to the folded sheets is controlled by a fixed cam 62 and four cam followers 63 which are in rolling contact with the surface of the cam 62 and which are supported on pivot arms 64 mounted on pivot pins 66 in the casting of member 54. It will therefore be noticed that the cam 62 has its relieved face portion 65 through approximately 90 degrees of the cam 62 and the followers 63 move into the relief portion 65 and thus rotate the shaft 66 for actuating the clamping action of the pads 61 at the appropriate moment, namely, when the sheets S are beneath the orbital device 12 and that is in the position of the shown sheet S in the dot-dash lines on the left in FIG. 1.

At this time it will now also be mentioned that the blades 19 for the blade chain 11 are in groups which are spaced apart, as shown by the two groups on the top extent of the chain 21 in FIG. 1. There are of course additional groups of blades 19 spaced entirely along the chain 21, but are not shown herein. Also, the movement and spacing for the pusher 17 is such that the folded sheets are placed onto the blades or fingers 19 to have a trailing portion of the folded sheets free or clear of any fingers 19, as shown, and that is approximately one-third or one-quarter of the length of the folded sheets S which are free of blades 19. Therefore, the two facing clamp pads 61 can clamp the sheets S at that one-quarter or one-third length and not be clamping the blades 19 since the pads 61 are clear of the blades 19, all as clearly indicated in FIG. 1. Of course the horizontal component of velocity for the clamp pads 61 at the point of clamping and picking up the sheets from the blades 19 is the same as the horizontal velocity of blades 19, and thus there is no increase or decrease of velocity for the sheets, and the sheets are moved in an arcuate path up to and into the grip of the facing belts 26 and 27, as previously mentioned. Further, as will be more clearly seen and mentioned later, the pads 61 have an orbiting motion relative to the center of the stationary shaft 56, and thus the sheets remain in the horizontal orientation when they are transferred from the blades 19 and up to the conveyor 13. To accomplish the retention of the horizontal orientation mentioned, the rotating member 54 carries a sprocket 67 at each of the four corners thereof, and the sprockets are rotatable on shafts 68 and engage a chain 69 extending over each of the four sprockets and over a center sprocket 71 which is in a non-rotating mounted position on the fixed shaft 56, and it will also be noticed that there are idler sprockets 72 and 73 over which the chain 69 extends. With that arrangement of sprocket and chain, the orbital nature of movement for the clamp pads 61 is accomplished and thus the sheets are held in the horizontal orientation when transferred to the elevating conveyor 13, since the chain 69 is immobile and the sprockets 67 will rotate relative to the chain 69. It will therefore be noticed that an upright bar 74 is mounted on each of the shafts 68 and is pinned thereto and remains in the upright position throughout the complete rotation of the member 54.

DETAILS OF THE REJECT OR ALTERNATIVE PATH

As described, the sheets S which are of proper length and thickness and the like are passed along in the system and onto the table 28 and to the left thereof where they are passed to a trimmer or stacked or any other procedure. However, if the sheets are not of acceptable or standard size as mentioned, then they are passed to a reject or alternative path, and they are ultimately placed into a reject tray 76 shown in FIG. 2. To place them into the tray 76, the rejected folded sheets S encounter a reject gate 77 which is mounted on a pivot 78 to move down into the path of the sheets when they come from the belts 26 and 46. The gate 76 simply drops down to have its end opposite the pivot 78 disposed in the path of the sheets and thereby guide the sheets upwardly and onto a conveyor 79 which is endless and is suitably mounted on pulleys 81, as shown. The conveyor 79 extends to the tray 76 for depositing the rejects into the tray 76. Also, the belt 46 extends in overlap with the belt 79 for guiding the sheets into the tray 76, as shown.

An electric solenoid 82 is suitably mounted and is connected by its arm 83 to the up-and-down pivoting gate 77 for drawing the gate 77 down into the path of the sheets and directing them onto the conveyor 79, as mentioned. A tension spring 84 is also connected to the arm 77 for pivoting the arm 77 upwardly and out of the path of the sheets when the sheets are not to be directed to the reject path mentioned. That is, when the solenoid 82 is not being energized, then the spring 84 keeps the reject gate 77 in the non-operative or upward position, as shown in FIG. 2. An electric wire 86 is connected to the solenoid 82 for energizing the solenoid 82. FIG. 1 shows a detector 87 which can be a standard piece of equipment, such as a photo cell and a standard shift register device and a computer, which, through a symbolic arrow 88 detects the standardization of the size of the sheets S passing therebelow. The photo cell aspect of the device 87 can read or detect the length of the folded sheets S, and, through additional conventional arrangements, even the thickness of the sheets S can be detected by electric means, and the device 87 also is in the nature of a micro-computer and can time the sending of an electric signal through the wire 86 which is connected thereto and to the solenoid 82. Thus, the solenoid 82 is signaled at the appropriate time to pivot the gate 77 downwardly when that particular group of folded sheets passes to the gate 77 and that particular group of folded sheets is then directed into the reject path described.

DETAILS OF THE CLAMP PADS 61

Figure 4:
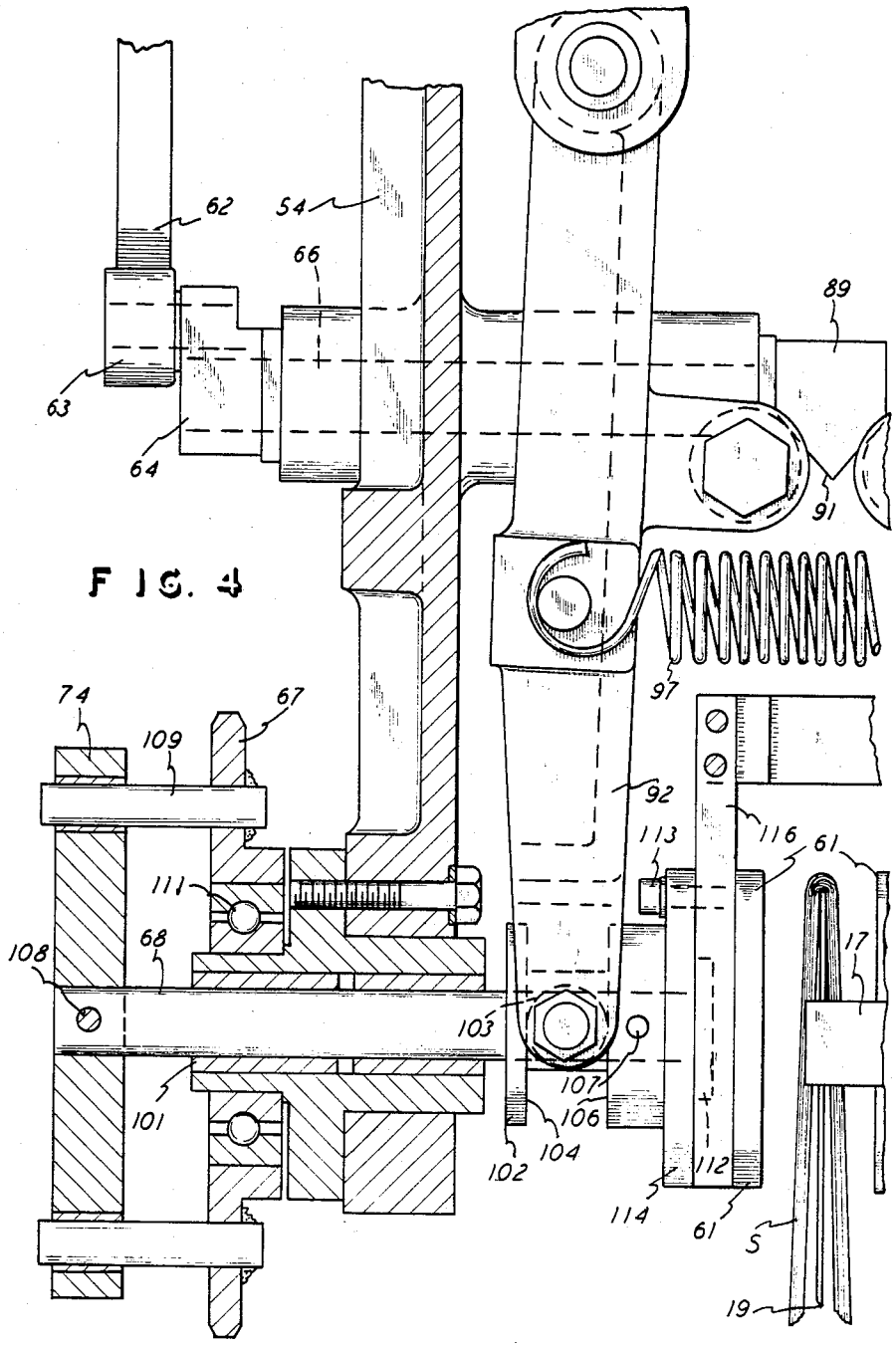
FIG. 4 is an enlarged sectional view taken along the line 4—4 of FIG. 1.
Figure 3:
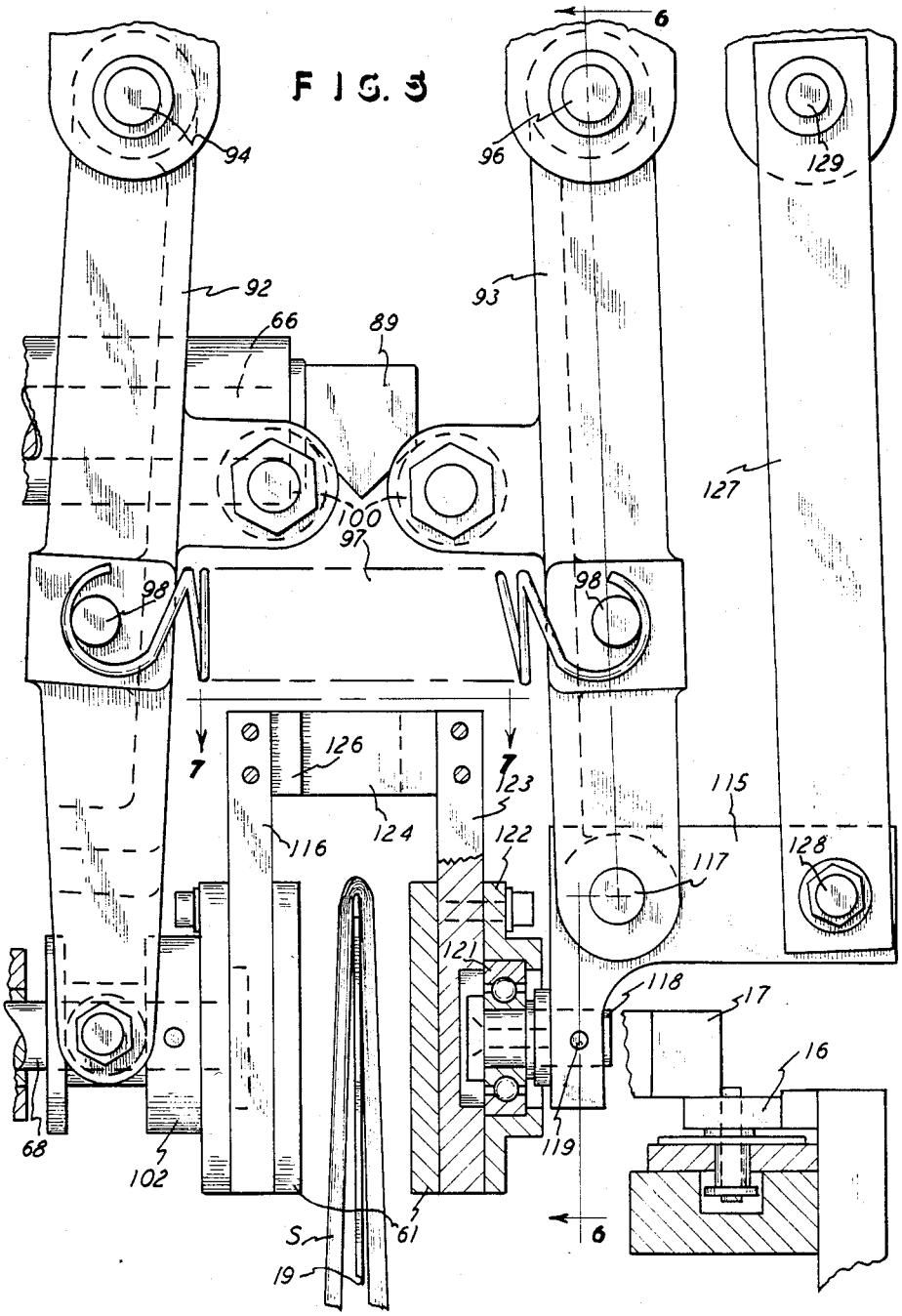
Figure 6:
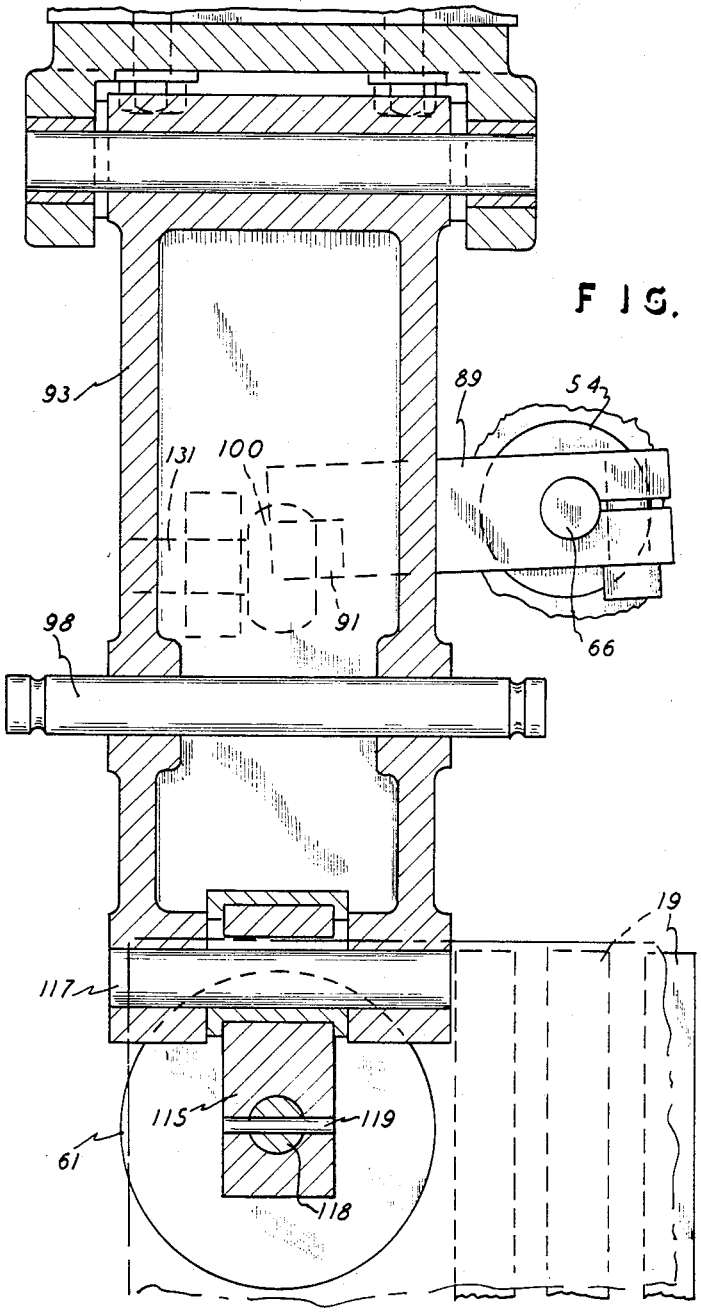
FIG. 6 is a sectional view taken along the line 6—6 of FIG. 5.

FIGS. 4, 5 and 6 show additional details of the clamp pads 61, and FIG. 4 shows the enlarged portion of the member 54 on which the cam lever shaft 66 is mounted which in turn carries the lever 64 which in turn carries the cam follower 63 shown in contact with the cam 62. The shafts 66 extend through the member 54 and each carries another lever 89 which extends to the same side of each shaft 66 as does the lever 64. That is, any upward or downward pivoting movement of the cam follower 63 will induce the same downward and upward pivotal movement of the lever 89 which has a lower wedge shape 91.

As shown in FIG. 5, each clamp pad 61 is suitably supported on the extending end of a pivoting arm 92 and 93 which respectively pivot on pins 94 and 96 mounted on the member 54. The arms 92 and 93 thus pivot toward and away from each other and thereby carry the clamp pads 61 toward and away from each other in the clamping of the sheets and the releasing of the sheets, as previously mentioned. A tension spring 97 is attached to pins 98 and 99 respectively on the arms 92 and 93 to pivot the arms 92 and 93 toward each other, and it will now be seen and understood that wedge lever 89 extends between the arms 92 and 93 to pivot the arms 92 and 93 away from each other and that is at a point of course when the pads 61 are away from each other and are therefore not carrying or clamping the sheets therebetween. The arms 92 and 93 each have rollers 100 thereon and in the path of the wedge lever 89 for easy action in permitting the wedge shape 91 to pivot the arms 92 and 93 away from each other. Of course that pivoting action is induced by the cam 62 and the cam foller 63 which is on the lever 64 which is also on that shaft 66, as mentioned. FIGS. 4 and 5 show the arms 92 and 93 pivoted away from each so that they are not placing the clamp pads 61 into the clamped position with the folded sheets shown therebetween. Of course when the cam 63 reaches the cam surface 67, then the spring 97 will be able to pivot the arms 92 and 93 toward each other, since the wedge lever 89 will then have been moved upwardly and will have released the arms 92 and 93 so that the clamp pads 61 can grip the folded sheets therebetween.

FIG. 4 shows that the shaft 68 is mounted in a sleeve bearing 101 for sliding axially therein, and the bearing is suitably supported in the member 54 and extends therethrough. The inner end of the shaft 68 carries a spool member 102 which flanks a roller 103 supported on the outer end of the arm 92. That is, the roller 103 abuts the faces 104 and 106 of the spool 102 for axial movement of the shaft 68 upon pivotal movement of the arm 92. The spool 102 is secured to the shaft 68 by a pin 107. The outer end of the shaft 68 has the member 74 secured thereon by a pin 108, and pins 109 extend from the member 74 and through the sprocket 67 which is supported by a bearing 111 on the outer end of the member 54, as shown in FIG. 4. The inner end of the shaft 68 carries the one clamp member 61 which is substantially a circular pad, as seen in FIG. 1. The assembly can be in any suitable manner, such as by the head 112 on the shaft 68 and the screw 113 extending through the backup plate 114 and through a bracket 116 to which the pad 61 is suitably secured.

Thus, upon pivotal movement of the arm 92, the shaft 68 is axially moved by means of the roller 103 contacting either one of the surfaces 104 or 106 of the spool 102. Also, through the connection between the sprocket 67 and the member 74 connected to the shaft 68, the pad 61 is retained in its upright orientation so that upon orbiting the shaft 56 the pad 61 will not rotate about its axis but will instead transport the folded sheets in the horizontal orientation and into the conveyor 13, as previously described.

Figure 7:
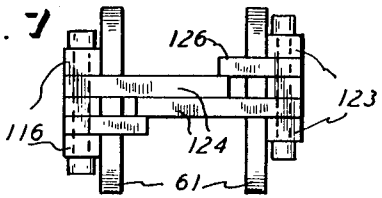
FIG. 7 is a top-plan view, on a reduced scale, and viewed along the line 7—7 of FIG. 5.

FIGS. 5 and 6 show the arm 93 which carries the member 115 at the outer end thereof on a pin 117 extending therethrough. A shaft 118 is pinned to the member 115 by the pin 119 and it carries a bearing 121 which in turn suitably supports a bracket 122 which connects with a bracket 123. Again, the pad 61 is suitably adhered or connected to the bracket 123. Thus, the bracket 123 can rotate on the bearing 121, and therefore the pad 61 when clamping the folded sheets therebetween will not rotate relative to each other, but instead will rotate in unison in order to retain the folded sheets in the horizontal orientation mentioned. To induce the same rotation between the brackets 116 and 123, as mentioned, the two brackets have inter-connecting arms 124 and 126 which are in sliding contact with each other when the brackets 116 and 123 move toward and away from each other, and thus the same rotational action is retained in the pads 61. FIG. 7 shows the top view of the brackets 116 and 123 and it shows the inter-connecting sliding arms or fingers 124 and 126.

To retain the shaft 118 on a substantially horizontal orientation while moving toward and away from the folded sheets, just as with the shaft 68, a link 127 is connected to the link 115 by a pin 28, and the link 127 is pivoted on the member 54 by the pivot pin 129. Thus, the arm 93 and the link 127 form a part of a four-bar linkage so that the shaft 118 will remain substantially horizontal when the pivoting action is occurring, and thus the bracket 123 and its pad 61 will not be moving on an arc and thereby upset the folded sheets.

FIG. 5 also shows the pusher clain 16 and its pusher 17 which is mounted on the chain and which extends to contact the trailing edge of the folded sheets, such as indicated in FIG. 4, and thereby move the folded sheet along the raceway, as mentioned.

FIG. 6 shows the sectioned view of the arm 93 and it shows a fragment of the folded sheets, in dot-dash position and it shows the three blades 19 of the blade conveyor 11. The view also shows how the clamp pad 61 engages the folded sheets S away from and clear of the blades 19, as previously mentioned, so that the clamp pads 61 can pick up the folded sheets off the blades 19.

FIG. 6 further shows the lever shaft 66 on the member 54, and it shows the wedge lever 89 with its wedge 91 adjacent the roller 100 shown rotatably mounted on its shaft 131 on the arm 93.

Accordingly the invention is to continuously move folded sheets along a raceway and into the control of a clamp which retains the sheets in the horizontal orientation while lifting the sheets and presenting them to a vertical conveyor which in turn lays the sheets on their sides and moves them to a collection point. Also, the invention provides for calipering the folded sheets and determining standardization of the size of the folded sheets and rejecting those folded sheets which are not of the standard size. Throughout the movement and process the sheets are moved at a continuous speed and actually a constant velocity so that there is a non-stop and continous and accurate movement of the folded sheets.

The cam surface 65 allows the pads 61 to move toward each other sufficiently to clamp thin sheets therebetween. Also, when the cams 63 are not on the surface 65, but have moved to a position adjacent another surface of the cam 62, then a spring 132 attached to each cam lever 64 will urge the levers 89 into contact with the rollers 100 to keep the levers 64 and 89 from being free to vibrate.

What is claimed is:

1. A method of transporting folded sheets from a raceway to a conveyor, comprising the steps of initially draping the folded sheets over a first section of the raceway which supports the sheets at a first folded angle and with the fold of the sheets being at the top of the sheets, moving the folded sheets along the raceway and transferring the folded sheets to a second section of the raceway at a folded angle less than the first folded angle, the folded sheets being supported on the raceway to have one end of the sheets along the fold free of any support, and then gripping the folded sheets at the fold where the sheets are free of support, and lifting the sheets upwardly off the raceway and depositing the folded sheets onto a horizontally moving conveyor.

2. The method of transporting folded sheets from a raceway to a conveyor as claimed in claim 1, where the sequence of the said moving and the said lifting of said folded sheets are performed in one vertical plane for non-stop movement of transporting the folded sheets from the raceway to the conveyor.

3. A method of transporting folded sheets from a raceway to a conveyor, comprising the steps of moving the folded sheets along a raceway and with the fold at the top and the sheets draped down over the raceway, the folded sheets being supported on the raceway to have one end of the sheets along the fold free of any support, gripping the folded sheets at the fold where the sheets are free of support, and lifting the sheets upwardly off the raceway and depositing the folded sheets onto a horizontally moving conveyor.

4. A method of transporting folded sheets in a non-stop movement, comprising the steps of disposing the folded sheets in an inverted V-shape position such that the fold is horizontally disposed, moving the folded sheets horizontally along an upright plane extending coincident the direction of the fold, lifting the folded sheets vertically in said upright plane while the fold remains horizontally disposed, moving said folded sheet out of said upright plane and turning the folded sheets onto their sides, and moving the folded sheets substantially horizontally with the fold in the leading position.

5. The method of transporting folded sheets in a non-stop movement as claimed in claim 2, including the step of gripping the folded sheets at the fold for the said lifting of the folded sheets.

6. A method of transporting folded sheets in a continuous movement, comprising the steps of disposing the folded sheets in an inverted V-shape position such that the fold is horizontally disposed, moving the folded sheets horizontally in the line along the direction of the fold, lifting the folded sheets vertically while the fold remains horizontally disposed, turning the folded sheets onto their sides, moving the folded sheets substantially horizontally with the fold in the leading position, the sequence of the said moving and the said lifting and the second said moving are all performed with said folded sheets moving at a constant velocity.

7. A method of transporting folded sheets in a continuous movement, comprising the steps of disposing the folded sheets in an inverted V-shape position such that the fold is horizontally disposed, moving the folded sheets horizontally in the line along the direction of the fold, lifting the folded sheets vertically while the fold remains horizontally disposed, turning the folded sheets onto their sides, moving the folded sheets substantially horizontally with the fold in the leading position, the sequence of the first said moving and the said lifting of the folded sheet being in an orbital path of movement such that the said fold remains horizontally disposed.

* * * * *